US010634023B2

(12) United States Patent
Soares et al.

(10) Patent No.: US 10,634,023 B2
(45) Date of Patent: Apr. 28, 2020

(54) VOLUME FLOW CONTROL VALVE

(71) Applicant: POLYTEC PLASTICS GERMANY GMBH & CO. KG, Lohne (DE)

(72) Inventors: Jorge Soares, Wettringen (DE); Christoph Leson, Dinklage (DE)

(73) Assignee: Polytec Plastics Germany GmbH & Co. KG, Lohne (DE)

( * ) Notice: Subject to any disclaimer, the term of this patent is extended or adjusted under 35 U.S.C. 154(b) by 0 days.

(21) Appl. No.: 16/307,224

(22) PCT Filed: Jun. 20, 2017

(86) PCT No.: PCT/EP2017/065080

§ 371 (c)(1),
(2) Date: Dec. 5, 2018

(87) PCT Pub. No.: WO2017/220572

PCT Pub. Date: Dec. 28, 2017

(65) Prior Publication Data

US 2019/0271243 A1 Sep. 5, 2019

(30) Foreign Application Priority Data

Jun. 23, 2016 (DE) ..... 10 2016 211 265

(51) Int. Cl.
*F01M 13/00* (2006.01)
*F01M 13/04* (2006.01)

(52) U.S. Cl.
CPC ..... *F01M 13/0011* (2013.01); *F01M 13/04* (2013.01); *F01M 2013/0016* (2013.01); *F01M 2013/0433* (2013.01); *F01M 2013/0438* (2013.01)

(58) Field of Classification Search
CPC ..... F01M 13/0011; F01M 13/04; F01M 2013/0438; F01M 2013/0433; F01M 2013/0016
See application file for complete search history.

(56) References Cited

U.S. PATENT DOCUMENTS

| | | | | |
|---|---|---|---|---|
| 3,108,798 | A | 10/1963 | McLagan | |
| 3,111,138 | A | 11/1963 | Humphreys et al. | |
| 3,645,242 | A | 2/1972 | Horiuchi | |
| 2006/0000459 | A1* | 1/2006 | Freeman | F01M 13/0011 123/574 |
| 2008/0257321 | A1* | 10/2008 | Knaus | F01M 13/0011 123/574 |

(Continued)

FOREIGN PATENT DOCUMENTS

| | | | |
|---|---|---|---|
| DE | 4022129 | C2 | 3/1993 |
| DE | 102005025864 | A1 | 12/2006 |

(Continued)

OTHER PUBLICATIONS

International Search Report for International Application No. PCT/EP2017/065080 dated Sep. 27, 2017.

*Primary Examiner* — Hung Q Nguyen
(74) *Attorney, Agent, or Firm* — Clements Bernard Walker

(57) ABSTRACT

The invention relates to a volume flow control valve with a control function for ventilating the crankcase of an internal combustion engine in a housing between a crank chamber of a crankcase and an intake tract with at least two openings between the crank chamber and the intake tract.

4 Claims, 3 Drawing Sheets

(56) References Cited

U.S. PATENT DOCUMENTS

| | | | | |
|---|---|---|---|---|
| 2011/0174397 | A1* | 7/2011 | Goerlich | F01M 13/0011 137/535 |
| 2013/0032115 | A1* | 2/2013 | Zitarosa | F01M 13/0011 123/188.8 |

FOREIGN PATENT DOCUMENTS

| | | | | |
|---|---|---|---|---|
| DE | 102005052340 | A1 | 4/2007 | |
| DE | 102008028543 | B3 * | 10/2009 | F01M 13/0011 |
| DE | 102009012872 | A1 | 10/2010 | |
| DE | 102010015030 | A1 | 4/2011 | |
| DE | 202010001191 | U1 | 5/2011 | |
| DE | 102008005409 | B4 | 8/2012 | |
| DE | 102016211265 | B4 | 1/2018 | |

* cited by examiner

VOLUME FLOW CONTROL VALVE

FIELD OF THE INVENTION

The invention relates to a volume flow control valve with a feedback-control function for ventilating the crankcase of an internal combustion engine in a housing between a crank chamber of a crankcase and an intake tract with at least two openings between the crank chamber and the intake tract.

BACKGROUND OF THE INVENTION

In the prior art, so-called "PCV valves" have been proposed and used. "PCV" means "positive crankcase ventilation" and is a ventilation valve, especially a volume flow control valve or flow rate control valve, which is supposed to ensure, for example, that the engine, especially of an automotive, is well ventilated by allowing part of the intake air to escape through the crankcase via this ventilation at idling speed, and when the load is low. Contamination of the engine oil by condensates is to be reduced thereby.

Usually, a piston in this valve regulates an opening cross-section that controls the air flow to the intake manifold or intake tract by means of a spring so that only a defined small amount of gas is allowed to pass, and thus the pressure difference is controlled.

DE 20 2010 001 191 01 U1 describes a valve for controlling a gas flow, a liquid separator, a ventilation system, and an internal combustion engine having such a valve. This utility model relates to a valve for controlling a gas flow from a discharge side to a suction side of the valve, comprising a valve closure, especially a valve disk, a valve opening closable by means of a valve closure, and a valve bearing in which the valve closure is supported by a spring, characterized in that said valve closure has one or more gas passing openings from the discharge side to the suction side of the valve.

DE 10 2008 005 409 B4 relates to a valve for ventilating the crankcase of an internal combustion engine. The patent relates to a valve for ventilating the crankcase of an internal combustion engine, wherein the valve comprises a fresh-air side for connection with an intake section, an engine side for connection with the crankcase and a valve insert movable as a whole for changing the flow resistance through the valve, wherein said valve insert is held inside said valve without preload, wherein a negative pressure on the fresh-air side relative to the engine side causes free displacement of the valve insert to a ventilation limit-stop position, and excess pressure on the fresh-air side relative to the engine side causes free displacement of the valve insert to another limit-stop position, wherein the valve insert is designed to open a ventilation cross-section in the ventilation limit-stop position, and wherein said valve insert has a covering element for covering at least one passage opening in said valve, wherein said covering element opens said at least one passage opening in a limit-stop position, and in the other limit-stop position, which is an aeration limit-stop position, opens an aeration cross-section that is different from the ventilation cross-section, and at least one passage opening is provided between the fresh-air side and the engine side, which is open independently of the position of the valve insert, in order to supply fresh air through the passage opening to the crankcase in the aeration limit-stop position, and to discharge blow-by gas through the passage opening from the crankcase in the ventilation limit-stop position.

DE 40 22 129 C2 relates to a pressure-control valve to be incorporated in a ventilation duct on an internal combustion engine. The pressure-control valve is characterized in that an intermediate valve is arranged between the valve plate of the diaphragm and the first valve seat at the bottom of the housing, which intermediate valve has a second valve seat facing towards the diaphragm and cooperates with the valve plate of the diaphragm, and comprises a valve plate facing towards the valve seat of the bottom of the housing and cooperates with it, wherein said intermediate valve is provided on the diaphragm in such a way that an axial relative movement between the diaphragm and the intermediate valve is possible.

U.S. Pat. No. 3,308,798 A describes a metering valve for a crankcase ventilation system.

U.S. Pat. No. 3,111,138 A describes a crankcase ventilation regulator.

In a similar way, the gas flow and the pressure drop are controlled by pressure-control valves with an elastomer diaphragm and a compression spring, or with the above mentioned PCV valves with a piston and compression spring in the prior art (DE 10 2009 012 872 A1; U.S. Pat. No. 3,645,242 A).

In particular, compression springs have also been used for regulating a diaphragm or the piston with a correspondingly large mounting space required. The oil separation was arranged separately. However, these require more mounting space, wherein the high flow rate required by the valve was not utilized for droplet separation from the blow-by gas.

BRIEF SUMMARY OF THE INVENTION

Accordingly, it has been the object of the present invention to limit the amount of gas for aerating or ventilating the crankcase, to regulate the reduced pressure in the crank chamber, optionally to separate the oil from the blow-by gas, and all this using a small and compact mounting space.

BRIEF DESCRIPTION OF THE DRAWINGS

The present invention is illustrated and described herein with reference to the drawing, in which like reference numbers denote like method steps and/or system components, respectively, and in which.

BRIEF DESCRIPTION OF THE INVENTION

Figure 1:
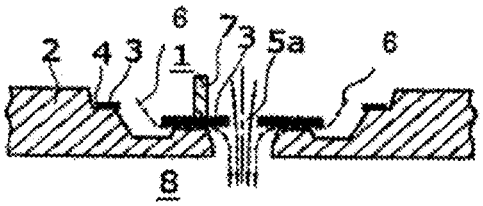
FIG. 1 is a side-view of a volume flow control valve having a feedback control function where the spring sheet has a constant opening according to the present invention.

In a first embodiment, the above object is achieved by a volume flow control valve with a feedback-control function for ventilating the crankcase of an internal combustion engine in a housing 2 between a crank chamber 1 of a crankcase and an intake tract 8 with at least two openings 5*a*, 5*b*, 6 between the crank chamber 1 and the intake tract 8, characterized in that the cross-section of at least one first opening 5*a*, 5*h* is generally constant, and the cross-section of at least one second opening 6 is spanned by at least one spring sheet 3, said spring sheet 3 opens a lower volume flow at first through the second opening 6 when the pressure difference between the crank chamber 1 and the intake tract 8 increases, switches at a defined high pressure drop, the spring sheet 3 thus reducing the cross-section of the second opening 6 and ultimately closing it, that the volume flow is localized through the first opening 5*a*, 5*b* and is limited to a lower level, even if the pressure difference increases further.

The volume flow control valve according to the invention controls the gas flow, or the pressure difference between the ventilated crankcase or crank chamber 1, and the intake tract 8. The valve directs the gas from the crank chamber 1 through the intake tract 8 into the combustion room, but it also avoids that a high reduced pressure propagates into the crankcase during partial load operation in the intake tract 8, for example, in an Otto engine.

The present invention provides a gas and pressure control with a defined valve characteristic diagram and a small mounting space. With at least one spring sheet 3, the flowed-through cross-section of opening 6 between the crankcase 1 and the intake tract 8 is reduced, and thus the gas flow and the pressure drop are controlled.

Another advantage of the present invention resides in the fact that there is only one movable element, namely spring sheet 3.

Spring sheet 3 serves to control the flowed-through cross-section. For example, spring sheet 3 can be mounted in the region of crank chamber 1 under a defined bias 4 to open the way of the gas flow through the opening 6. If the pressure drop increases because of a higher suction pressure, the spring sheet 3 will move towards the wall of the housing 2 up to the point where the opening 6 is completely closed.

Figure 2:
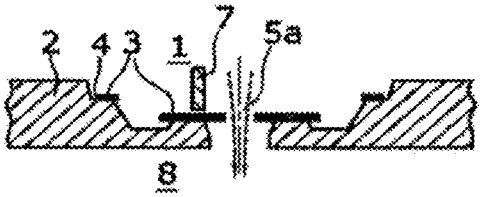
FIG. 2 is a side-view of a volume flow control valve ha g a feedback control function where the spring sheet has a constant opening according to the present invention.

FIGS. 1 and 2 represent a volume flow control valve having a feedback control function according to the invention, preferably for aeration or ventilation, which is mounted in an internal combustion engine, for example, in a housing 2 between a crank chamber 1 of a crankcase and an intake tract 8, which, when the pressure difference between the two spaces 1 and 8 interconnected through the valve increases, has a volume flow rate that also increases at first. The downholder 7 provides that the spring sheet 3 can move only up to a topmost position point in a rest position when the latter is in a state of rest. The switching point of the valve is also set thereby.

Figure 3:
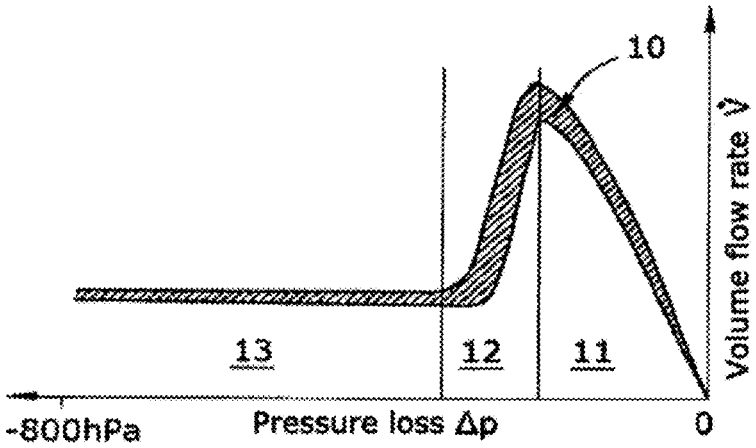
FIG. 3 represents the pressure course or the pressure loss as a function of the volume flow rate of the blow-by gas according to the present invention.

FIG. 3 represents the pressure course or the pressure loss as a function of the volume flow rate of the blow-by gas. With increasing pressure loss, the volume flow rate V within the range 11 increases at first to a maximum of 10. Now, the spring sheet 3 switches. At a defined higher pressure loss in the range 12 of FIG. 3 after leaving range 11, the valve reduces the cross-section of the opening gap 6 in such a way that the volume flow rate is reduced again even when the pressure difference increases further, the remaining opening 5*a*, 5*b* being unaffected thereby. If the pressure loss increases further after the opening 6 has been closed, the gas can flow only through the opening 5*a*, 5*b*. However, since the cross-section of the opening 5*a*, 5*b* is constant, the volume flow rate is limited.

Figure 4:
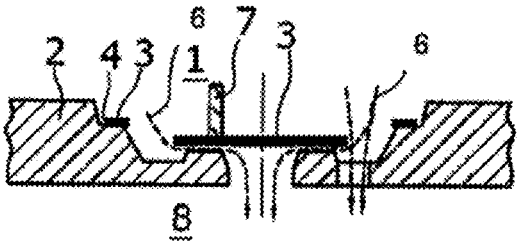
FIG. 4 is a side-view of a volume flow control valve having a feedback control function with a constant opening shown through a hole in the housing 2 according to the present invention.
Figure 5:
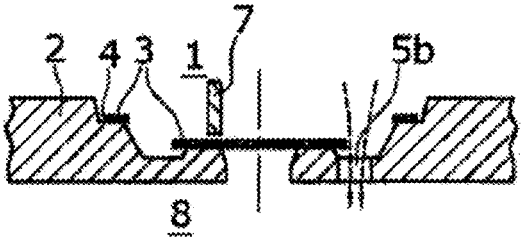
FIG. 5 is a side-view of a volume flow control valve having a feedback control function with a constant opening shown through a hole in the housing according to the present invention.

While the spring sheet has the constant opening 5*a* in FIGS. 1 and 2, the constant opening is shown through a hole 5*b* in the housing 2 in FIGS. 4 and 5.

Thus, in contrast to valves having a similar mechanism, the control function is represented by at least one spring sheet 3 in the volume flow control valve according to the invention, which reduces the size of at least one opening 6 or one corresponding gap when the pressure loss increases (from range 11 through 12 and 13 in FIG. 3), and sets the switching range 12 to the lower volume flow level 13 through a possible bias, for example, through a metal sheet structure 4 on the housing 2 and optionally additional downholders 7.

In another preferred embodiment of the present invention, the volume flow control valve is characterized by having at least one flow barrier 9 for deviating the gas flow in the intake tract 8 downstream of the openings 5. The separation of oil from a blow-by gas into the structure according to the invention can be integrated thereby. Thus, the oil separation unit is arranged separately and is not a direct or necessary component of the valve, but a preferred component of the concept according to the invention, resulting in a separation of the oil droplets from the blow-by gas leaving the crankcase.

Figure 6:
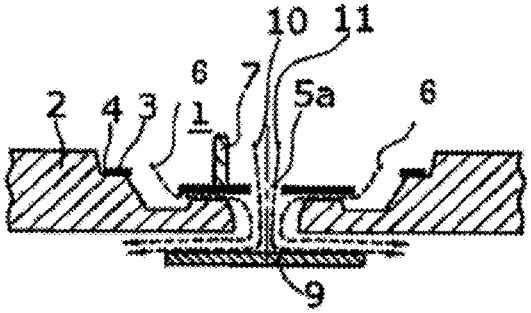
FIG. 6 is a side-view of a volume flow control valve according to the present invention.
Figure 7:
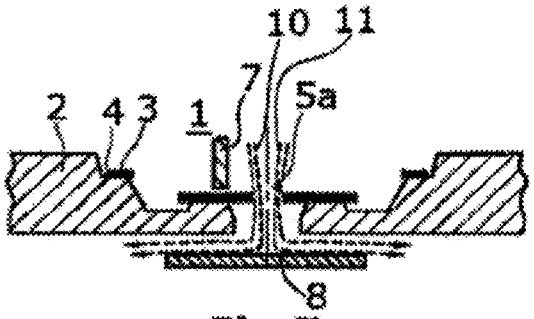
FIG. 7 is a side-view of a volume flow control valve according to the present invention.
Figure 8:
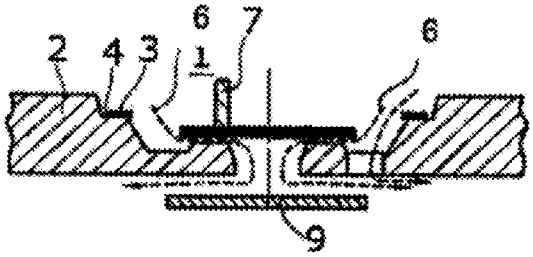
FIG. 8 is a side-view of a volume flow control valve according to the present invention.
Figure 9:
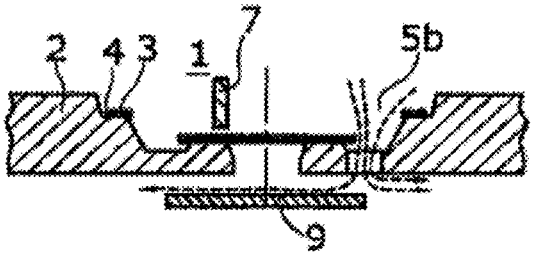
FIG. 9 is a side-view of a volume flow control valve according to the present invention.

FIGS. 6 to 9 represent analogous volume flow control valves according to the invention corresponding to FIGS. 1 to 4, which differ from the latter Figures only by the presence of the additional flow barrier 9. Because of the forced change of direction of the gas flow, oil droplets separate here, which can be recycled into the oil circulation of the internal combustion engine. While FIG. 7 shows the closed position of FIG. 6, FIG. 9 shows the closed position of FIG. 8. Here too, the flowed-through cross-section of opening 6 and thus the gas flow and the pressure drop are controlled by spring sheet 3. The high flow rate accelerates the droplets that impinge when redirected, in particular, against a non-woven or a baffle 9 and adhere thereto. The aerosol from the crank chamber 1, which is usually a mixture (for example, blow-by) of gas and air as well as gas-home particles (for example, oil droplets), should be recirculated to the intake tract 8 and thus to combustion without oil fractions if possible. The aerosol flows through the volume flow control valve according to the invention through the cross-sections of openings 5, which are small in comparison. Because of the cross-section reduction of the free travelling path, the flow rate increases, and the gas-borne particles are accelerated. Shortly behind the housing opening, which separates the crank chamber 1 from the intake tract 8, the flow barrier 9 is localized, which is flowed at or flowed through, for example, and redirects the gas flow. Because of the inertia of the droplets in the aerosol, the latter impinge against the barrier 9 and are thus separated or deposited from the gas flow for the major part thereof.

Figure 10:
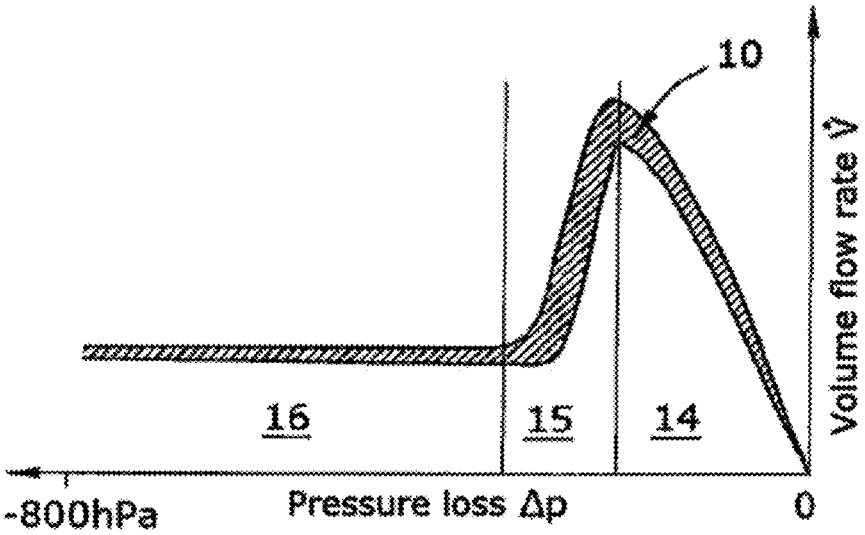
FIG. 10 shows a pressure loss/volume flow curve for the present invention.

Therefore, the characteristic pressure loss/volume flow curve according to FIG. 10 corresponds to that in FIG. 3, so that the ranges 14, 15 and 16 correspond to those of ranges 11, 12 and 13 of FIG. 3.

Figure 11:
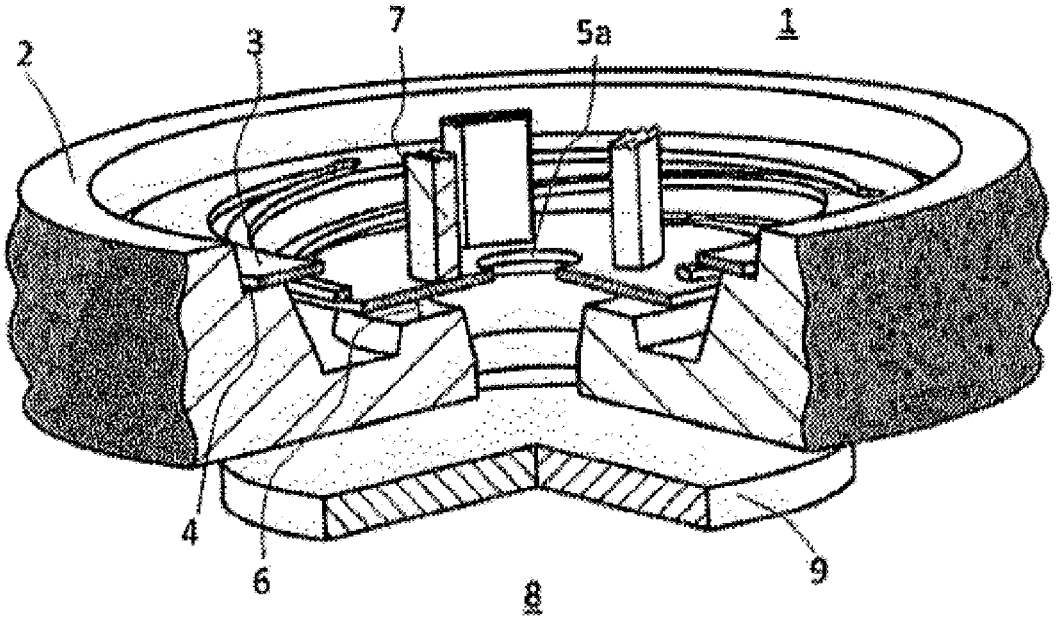
FIG. 11 is a cut-away perspective view of a volume flow control valve according to the present invention.

In FIG. 11, the volume flow control valve according to the invention in accordance with FIG. 1 is represented threedimensionally. The reference symbols have corresponding meanings. It can be seen that the openings 6 are not local openings, but a cleaning gap. Thus, the annular spring sheet 3 closes this cleaning gap 6.

The invention claimed is:

1. A volume flow control valve with a feedback-control function for ventilating a crankcase of an internal combustion engine in a housing between a crank chamber of the crankcase and an intake tract with at least two openings between the crank chamber and the intake tract, characterized in that the cross-section of at least a first opening of said at least two openings is generally constant, and the cross-section of at least a second opening of said at least two openings is spanned by at least one spring sheet, said spring sheet opens a lower volume flow at first through the second opening of said at least two openings when the pressure difference between the crank chamber and the intake tract increases, and switches at a defined high pressure drop, the spring sheet reduces the cross-section of the second opening of said at least two openings and closes it, so that the lower volume flow is localized through the first opening of said at least two openings and is limited to a lower level, even if the pressure difference increases further.

2. The volume flow control valve according to claim 1, characterized in that the spring sheet is attached at the housing with a bias by a downholder.

3. The volume flow control valve according to claim 1, characterized by having a flow barrier for deviating a gas flow in the intake tract downstream of the at least two openings.

4. The volume flow control valve according to claim 3, characterized in that the flow barrier comprises a non-woven and/or a baffle, which separate gas-borne particles from the gas flow.

* * * * *